US007738233B2

(12) United States Patent
Frenz et al.

(10) Patent No.: US 7,738,233 B2
(45) Date of Patent: Jun. 15, 2010

(54) METHOD AND DEVICE FOR OPERATING AN INDUCTIVE LOAD WITH DIFFERENT ELECTRIC VOLTAGES

(75) Inventors: Thomas Frenz, Noerdlingen (DE); Juergen Eckhardt, Markgroeningen (DE); Hans-Friedrich Schwarz, Muehlacker (DE); Bernd Schroeder, Esslingen (DE); Timm Hollmann, Ludwigsburg (DE); Joerg Kuempel, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 595 days.

(21) Appl. No.: 10/996,484

(22) Filed: Nov. 24, 2004

(65) Prior Publication Data

US 2005/0128658 A1 Jun. 16, 2005

(30) Foreign Application Priority Data

Dec. 16, 2003 (DE) ..... 103 58 858

(51) Int. Cl.
*H01H 47/28* (2006.01)
*H01H 47/32* (2006.01)
*H01H 47/00* (2006.01)

(52) U.S. Cl. ..... 361/153; 361/152; 361/191

(58) Field of Classification Search ..... 361/153
See application file for complete search history.

(56) References Cited

U.S. PATENT DOCUMENTS

| | | | | |
|---|---|---|---|---|
| 4,978,865 | A * | 12/1990 | Hartmann et al. | 307/140 |
| 5,016,175 | A * | 5/1991 | Baltusis et al. | 701/58 |
| 5,113,307 | A * | 5/1992 | Meyer et al. | 361/154 |
| 5,757,214 | A * | 5/1998 | Stoddard et al. | 327/110 |
| 6,169,335 | B1 * | 1/2001 | Horsak et al. | 307/10.1 |
| 6,297,941 | B1 | 10/2001 | Hoffmann et al. | |
| 7,180,279 | B2 * | 2/2007 | Novak | 323/283 |
| 2002/0017379 | A1 * | 2/2002 | Jackson | 165/95 |
| 2002/0050579 | A1 * | 5/2002 | Near | 251/129.05 |

FOREIGN PATENT DOCUMENTS

| | | |
|---|---|---|
| CA | 1 276 679 | 11/1990 |
| DE | 35 43 055 | 12/1986 |
| DE | 44 44 810 | 6/1996 |
| GB | 2 335 797 | 9/1999 |
| JP | 63-202902 | 8/1988 |

* cited by examiner

*Primary Examiner*—Stephen W Jackson
*Assistant Examiner*—Dharti H Patel
(74) *Attorney, Agent, or Firm*—Kenyon & Kenyon LLP

(57) ABSTRACT

A method for operating an inductive load, which is operated in a motor vehicle with electric voltages of different magnitudes, is provided, a current rise in the inductive load being influenced by selecting pulse lengths and pulse pauses of the electric voltage.

11 Claims, 2 Drawing Sheets

METHOD AND DEVICE FOR OPERATING AN INDUCTIVE LOAD WITH DIFFERENT ELECTRIC VOLTAGES

FIELD OF THE INVENTION

The present invention relates to a method for operating an inductive load with different electric voltages as well as an adjusting device and a control unit.

BACKGROUND OF THE INVENTION

In the area of engine management for gasoline and diesel engines, components representing an inductive load are frequently used such as quantity-control valves of high-pressure pumps or injection valves, for example. These components are typically triggered via a simple switch output stage.

As a result of fluctuations in the vehicle system voltage, the components behave differently, depending on the vehicle system voltage currently available. This changes especially the metering behavior of valves, particularly of injection valves. It is possible to compensate for changes in the metering behavior caused by fluctuations in the vehicle system voltage for example by extending or shortening the triggering times of the affected components accordingly. Since the metering behavior, however, is not necessarily a linear function of the vehicle system voltage, such compensation is costly.

Further there is the danger that, in the event of very high voltages, the current rises to such a magnitude that the stress on the components becomes unacceptably high such that the component must be switched off above a certain voltage. This results in undesirable restrictions of the functionality of the system as a whole.

To reduce the current stresses on a component, there is to an extent the possibility of shortening the switching time. Here there is the risk, however, that a reliable opening or closing of a valve is no longer ensured when switching times are all too short.

German Patent Application No. DE 4444810 describes a control circuit, in which a blower drive motor is triggered by a pulse-width modulation signal (PWM signal), the pulse duty factor of the PWM signal being a function of an adjustable setpoint rotational speed. If the rotational speed deviates from the setpoint rotational speed, for example due to varying electrical voltages, the rotational speed is returned to the setpoint rotational speed via a control circuit by changing the pulse duty factor of the PWM signal.

SUMMARY OF THE INVENTION

The method according to the present invention for operating an inductive load has the advantage that the current rise in the inductive load can be influenced by selecting pulse lengths and pulse pauses of the electric voltage. This procedure advantageously allows for the time characteristic of the current rise to be shaped in diverse ways and to adapt them to the respective requirements. In particular, it is possible to limit the magnitude of the current rise and thus to protect the inductive load from being destroyed by an excessively high current. This advantageously also allows for an operation in higher voltage ranges, which until now were not accessible due to the high current rise to be expected.

It is especially advantageous to influence the current rise in the inductive load only when the magnitude of the electric voltage exceeds a normal voltage.

According to a further preferred specific embodiment, a current rise is reproduced by a suitable choice of pulse lengths and pulse pauses of a pulsed voltage, which essentially corresponds to a current rise that sets in in a characteristic manner when a normal voltage is applied to the inductive load. Such a procedure makes it possible to design the inductive load or component advantageously only for operation at normal voltage since at all other voltages the current rise is adapted accordingly and the component is protected against destruction.

In a further preferred specific embodiment, an adjusting device having an inductive load is provided, which is operated at electric voltages of different magnitudes and in which the current rise in the inductive load is influenced by selecting pulse lengths and pulse pauses of the electric voltage.

In a further refinement, the adjusting device takes the form of a quantity-control valve, the duration of the supply of current advantageously being such that the quantity-control valve reliably closes or opens.

In another refinement of the present invention, a control unit for operating at least one adjusting device having an inductive load is provided, which is operated at electric voltages of different magnitudes and in which the current rise in the inductive load is influenced by selecting pulse lengths and pulse pauses of the electric voltage.

For generating the voltage pulses, characteristic quantities for different voltages are advantageously stored in a storage medium of the control unit.

In a further advantageous manner, a control element containing a program in a storage device is provided, which is executable particularly on a microprocessor and is suited for implementing the method according to the present invention.

DETAILED DESCRIPTION

Figure 1:
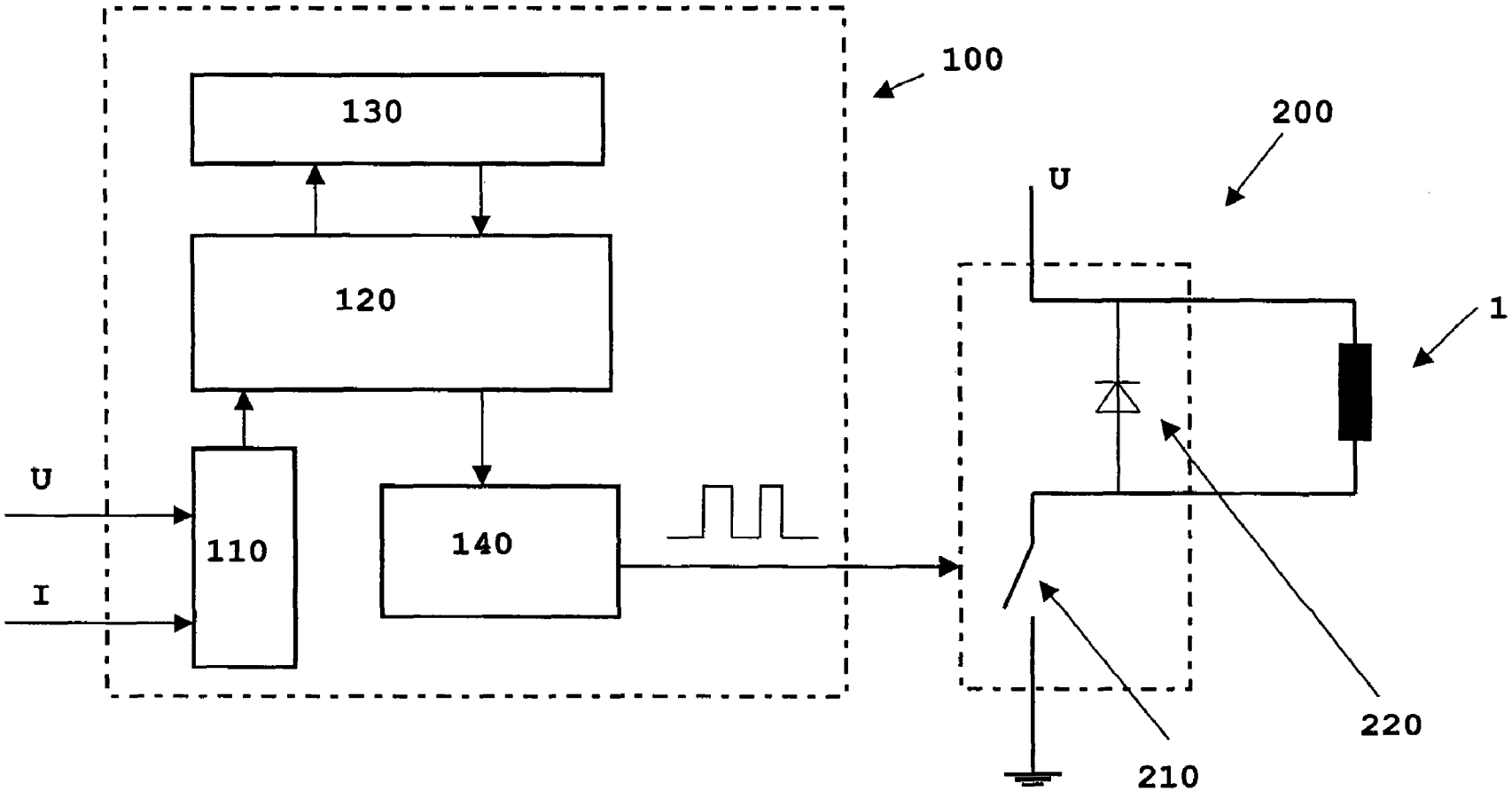
FIG. 1 shows a basic circuit diagram of a system according to the present invention.

FIG. 1 shows a basic circuit diagram of a system according to the present invention having an inductive load of an adjusting device 1, a control unit 100 and an output stage 200. Current I and voltage U of adjusting device 1 are acquired via an analog/digital converter 110 and are transmitted to a microprocessor 120 having a control element 130. Following the evaluation of current and voltage, microprocessor 120 transmits suitable characteristic quantities to a modulator 140. Depending on the specific embodiment, suitable characteristic quantities are either ascertained directly from one or multiple measured values or suitable characteristic quantities are stored in control element 130 or in a so-called characteristics map. For an existing voltage, the corresponding characteristic quantities are then read out from a characteristics map. From the characteristic quantities, modulator 140 generates a pulsed signal, for example by pulse-width modulation, which is used to control an output stage 200. Essentially via a switching element 210, the electric circuit is opened or closed in output stage 200 via adjusting device 1 in accordance with the applied pulsed signal. Via a free-wheeling diode 220, the voltage induced in opening switching element 210 is short-circuited.

Figure 2:
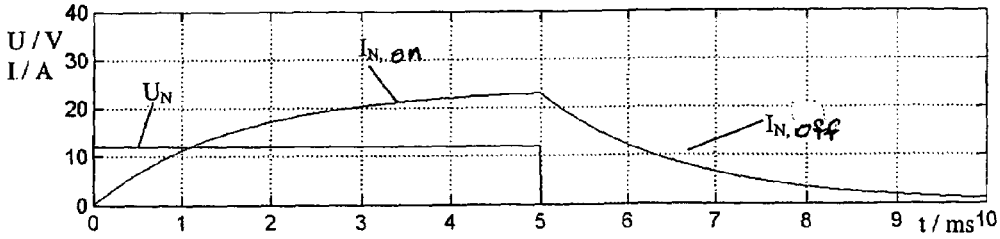
FIG. 2 shows a current and voltage timing diagram at a normal voltage.

FIG. 2 shows the time characteristic of current and voltage in the switching of an inductive load. When applying voltage to the inductive load, the current $I_{N,on}$ rises in a manner characteristic for an inductor. Following the disconnection of the voltage $U_N$, the induced voltage is erased via a free-wheeling diode and the current $I_{N,off}$ drops off exponentially. In the case represented, a voltage $U_N$ of 12 volts is applied to the inductive load for a duration of 5 ms. Depending on the electric resistance and the existing inductance, this results in a characteristic current rise $I_{N,on}$, which in the case shown reaches a peak current of approx. 23 amperes after 5 ms. Under constant conditions—resistance, temperatures etc.—the current rise $I_{N,on}$ always occurs in the same characteristic manner when the same voltage $U_N$ is applied. The following equation applies:

$$I_{on} = \frac{U}{R}\left(1 - e\frac{tR}{L}\right)$$

where U=voltage, R=resistance, t=time, L=inductance

Figure 3:
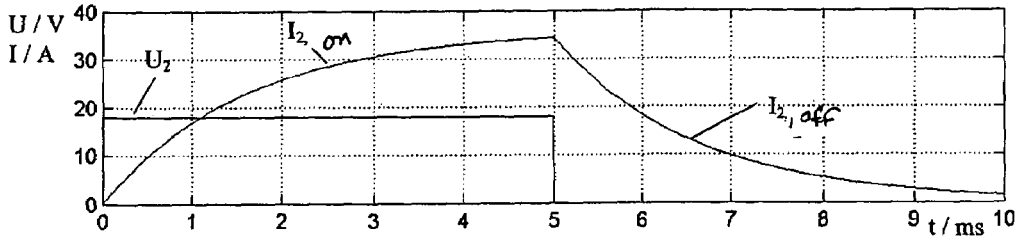
FIG. 3 shows a current and voltage timing diagram at a voltage above a normal voltage.

Under otherwise identical conditions, a steeper current rise $I_{2,on}$ sets in as a consequence of a higher voltage $U_2$. FIG. 3 shows that triggering with 18 volts and an identical triggering duration, current rise $I_{2,on}$ occurs more quickly than at 12 volts and a maximum current of approx. 35 amperes is achieved. To prevent a destruction of the component by an excessively high current, the component is normally switched off when a certain voltage or current is exceeded.

Figure 4:
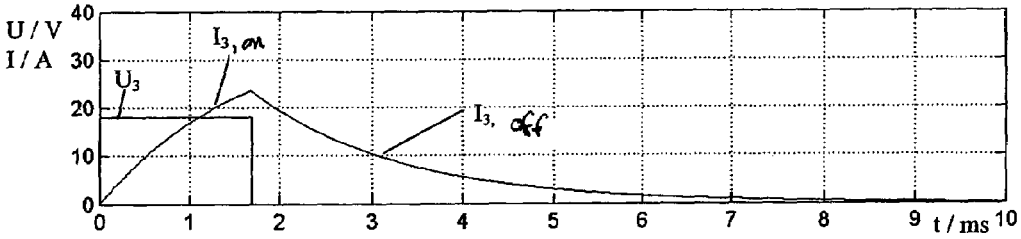
FIG. 4 shows a current and voltage timing diagram at a voltage above a normal voltage and a short power-on time.

Alternatively, the triggering duration may be shortened, as shown in FIG. 4. The peak current $I_{N,on}$ of approx. 23 amperes existing at 12 volts after 5 ms is already reached after approx. 1.8 seconds at a voltage $U_3$ of 18 volts. Although the component is protected by such a measure from excessively high current stresses, it is doubtful whether a reliable functionality of the component, particularly at very short triggering times, is still guaranteed. If for example an electromagnetic valve is triggered only very briefly, then the energy transmission to the armature of the valve may be so small that a reliable opening or closing is no longer possible.

Figure 5:
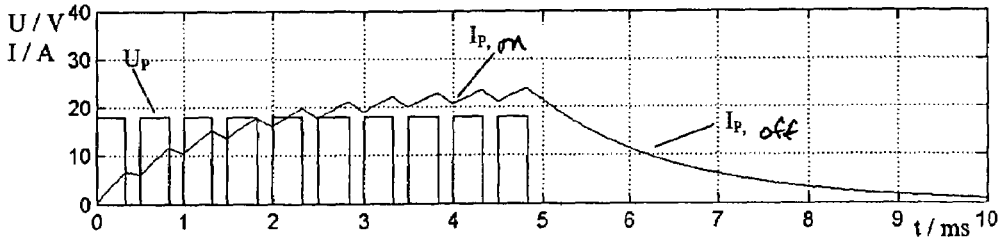
FIG. 5 shows a current and voltage timing diagram at a pulsed voltage.

FIG. 5 shows the time characteristic of current $I_{p,on}$ and voltage $U_p$ of an adjusting device according to the present invention at a voltage $U_p$ of 18 volts, which is greater than a specified normal voltage $U_N$. Normal voltage $U_N$ may be freely defined and amounts to 12 volts in the exemplary embodiment considered. The current rise characteristically setting in at this normal voltage $U_N$ is known as described and defines a normal current rise $I_{N,on}$. In order to ensure a constant functionality of a component at different voltages, voltage $U_p$ is pulsed according to the present invention at voltages $U_p$ that are higher than normal voltage $U_N$. As long as a voltage pulse is applied, current $I_{p,on}$ rises in accordance with the applied voltage $U_p$. During a pause pulse, current $I_{p,on}$ decreases accordingly. The pulse lengths and pulse pauses of the pulsed voltage $U_p$ are to be chosen in such a way that the current characteristic $I_{p,on}$ on average corresponds essentially to normal current rise $I_{N,on}$ Current $I_{p,on}$ here fluctuates around normal current rise $I_{N,on}$ in a fluctuation range ΔI.

The following equation applies:

$$I_{p,ein}(t_i) \in [I_{n,ein}(t_i) \pm \Delta I]$$

That is to say, for every time $t_i$, current $I_{p,on}(t_i)$ is found in an interval that is specified by current $I_{N,on}$ of a normal current rise at time $t_i$ and a tolerable fluctuation range ΔI of the current. With increasing pulse frequency of the pulsed voltage $U_p$ or a rapid automatic control, the fluctuation range ΔI decreases.

According to this specification, an exemplary embodiment provides for an actual current to be measured and compared to the setpoint current that should obtain according to normal current rise $I_{n,on}(t_i)$ at measuring time $t_i$. If the actual current is above the setpoint current, then the voltage pulse will be switched off, and if the actual current drops below the value of the setpoint current, then the voltage will be switched on again. The introduction of suitable threshold values for voltage pulsing, for example, or suitable automatic control mechanisms ensures that current characteristic $I_{p,on}$ remains within the tolerated current interval. Such an automatic control, for example, can enter into a typical pulse width modulation (PWM), a control unit transmitting a modified PWM signal to an output stage, via which then an appropriate component is triggered. Such a procedure turns the switched output stage into a current-controlled output stage.

In a further exemplary embodiment, suitable characteristic quantities are stored in a characteristics map for the different voltages in a control element—e.g. a read-only memory (ROM) chip—so that it is possible to retrieve corresponding characteristic quantities for an existing voltage in order to provide a suitable trigger signal for the supply of current to a component.

In addition, it is conceivable to take the temperature dependence of the component into account in that for example the temperature influence is modeled or measured and appropriate correcting quantities are stored in a characteristics map. In the current-controlled output stage described in the first exemplary embodiment, the temperature compensation already exists implicitly. Since the automatic control always sets the actual current to the temperature-independent setpoint current, a temperature-related change of the actual current is irrelevant.

Furthermore, the method according to the present invention has the advantage that, for example, a quantity-control valve can be operated even at high voltages, as occur in a booster start for example, by an appropriate triggering of the PWM. Moreover, the reproducible triggering of the components improves, for example, the closing and opening behavior. With a suitable triggering of a quantity-control valve, the automatic control of the rail pressure can be improved in this manner.

Furthermore, it is conceivable to provide a pulses voltage—e.g. in pulse-width modulation—only for certain voltage ranges, for example 6-24 volts, or only for voltages above 12 volts as a protective function.

In a further refinement, the normal voltage or the normal voltage rise is fixed in such a way that the component operates in an optimal operating range, which is typically the minimum voltage in normal operation. Furthermore, the components, particularly the magnetic circuit and the coils, can be optimally configured for an operating temperature.

It is furthermore advantageous that an unwanted extension of the switching time of the component, particularly of a component having a free-wheeling diode, is avoided by the method according to the present invention.

The procedure according to the present invention, of ensuring a characteristic and reproducible current rise in the application of voltage to a component, results in further advantageous refinements. The reproducible current rise, for example, increases the metering accuracy of injection valves. A costly application of the nonlinear behavior on the basis of a variable triggering of the components is eliminated. The operating range of the components can be extended significantly, for example in booster operation. In addition, greater freedoms are obtained in the design of the components. The power loss is low in comparison to an uncompensated triggering, and there is a correspondingly lower generation of heat. The limiting of the current additionally results in a protection of the components and the peripherals, e.g. circuit traces, connectors, cables etc.

Furthermore, an unwanted extension of the switching time of the components to higher voltages, particularly of a component having a free-wheeling diode, is avoided. Without a procedure according to the present invention, more magnetic energy is stored in the inductor of the component at higher voltages, due to the higher current, than at lower voltages. When switching off the component, the deletion time is extended accordingly. Although it is possible to shorten the pickup time within certain limits at higher voltages, overall the switching time as the sum of pickup time and deletion time becomes longer.

Current rises, however, may be caused not only by higher voltages, but also by a changing ohmic resistance of the component. The ohmic resistance is temperature-dependent and typically drops with decreasing temperature. If at start-up, for example, the temperature of a component is below the operating temperature, then without a procedure according to the present invention, the current rise will be faster due to the lower resistance. The higher maximum current, however, results overall in longer switching times. Such temperature-dependent changes in switching times are avoided by the current adaptation according to the present invention.

In a further refinement, varying PWM signals and thus varying amperages are used within one switching period of the component. A high amperage is supplied in the pickup of the component and a lower amperage in holding it.

In a further refinement, it is conceivable that the time characteristic of the current rise is influenced in an arbitrary manner when switching on an inductive load. For example, it is possible to let the current initially rise quickly and then to transition to a small or constant current rise. The varying choice and design of the pulse lengths and pulse pauses of the electric voltage as well as of the frequency, the amplitude and also the form of the pulses result in multiple possibilities for influencing the current rise.

In a further exemplary embodiment, a quantity-control valve is triggered when starting an internal combustion engine. Triggering typically occurs over a longer period, the quantity-control valve being accordingly thermally highly stressed. In the zero-current-open concept, the quantity-control valve must be supplied with current during the entire start phase in order to produce the high-pressure start in the internal combustion engine. A relatively high amperage is required to close the quantity-control valve. Subsequently, the amperage can be reduced for holding the quantity-control valve, the thermal stress on the quantity-control valve being significantly lower on the one hand and less energy being required on the other.

It is also conceivable to supply current to the quantity-control valve prior to activating the starter of the internal combustion engine, if the battery voltage is low in the event of very low temperatures for example. Prior to activating the starter, the available battery voltage is still greater (e.g. 8 volts) than during the activation of the starter (e.g. 6 volts). During the activation of the starter, the quantity-control valve would already be pulled up, and the voltage required for holding the quantity-control valve would be lower (e.g. 4 volts).

What is claimed is:

1. A method for operating an inductive load, which is operated in a motor vehicle with electric voltages of different magnitudes, the method comprising:

influencing a current rise in the inductive load by selecting pulse lengths and pulse pauses on the basis of an existing electric voltage; and in electric voltages that are greater than a normal voltage, choosing the pulse lengths and pulse pauses of the electric voltage in such a way that the current rise substantially corresponds to a current rise that sets in in a characteristic manner when the normal voltage is applied to the inductive load.

2. The method according to claim 1, wherein the current rise in the inductive load is influenced only when a magnitude of the electric voltage exceeds the normal voltage.

3. An adjusting device comprising:

an inductive load operated in a motor vehicle with electric voltages of different magnitudes; and an arrangement for influencing a current rise in the inductive load by selecting pulse lengths and pulse pauses on the basis of an existing electric voltage, wherein in electric voltages that are greater than a normal voltage, the pulse lengths and pulse pauses of the electric voltage are chosen in such a way that the current rise substantially corresponds to a current rise that sets in in a characteristic manner when the normal voltage is applied to the inductive load.

4. The adjusting device according to claim 3, wherein the current rise in the inductive load is influenced only when a magnitude of the electric voltage exceeds the normal voltage.

5. The adjusting device according to claim 3, wherein the adjusting device is a quantity-control valve and a duration of a supply of current to the quantity-control valve is such that the quantity-control valve reliably closes and opens.

6. A control unit for operating at least one adjusting device having an inductive load, which is operated in a motor vehicle with electric voltages of different magnitudes, the control unit comprising:

an arrangement for influencing a current rise in the inductive load by selecting pulse lengths and pulse pauses on the basis of an existing electric voltage, wherein in electric voltages that are greater than a normal voltage, the pulse lengths and pulse pauses of the electric voltage are chosen in such a way that the current rise substantially corresponds to a current rise that sets in in a characteristic manner when the normal voltage is applied to the inductive load.

7. The control unit according to claim 6, wherein the current rise in the inductive load is influenced only when a magnitude of the electric voltage exceeds the normal voltage.

8. The control unit according to claim 6, further comprising a storage medium for storing characteristic quantities for different voltages, for generating voltage pulses.

9. A control element for a control unit for operating at least one adjusting device having an inductive load with different electric voltages in a motor vehicle, the control element storing a program which when executed by a processor perform the following:

influencing a current rise in the inductive load by selecting pulse lengths and pulse pauses on the basis of an existing electric voltage, wherein in electric voltages that are greater than a normal voltage, the pulse lengths and pulse pauses of the electric voltage are chosen in such a way that the current rise substantially corresponds to a current rise that sets in in a characteristic manner when the normal voltage is applied to the inductive load.

10. The control element according to claim 9, wherein the control element is a read-only memory.

11. The control element according to claim 9, wherein the control element is a flash memory.

* * * * *